United States Patent [19]

Baba

[11] 4,448,056

[45] May 15, 1984

[54] INFEED MECHANISM FOR A PRESS

[75] Inventor: Kiyokazu Baba, Komatsu, Japan

[73] Assignee: Kabushiki Kaisha Komatsu Seisakusho, Tokyo, Japan

[21] Appl. No.: 425,974

[22] Filed: Sep. 28, 1982

[30] Foreign Application Priority Data

Oct. 12, 1981 [JP] Japan ..... 56-150015[U]
Oct. 12, 1981 [JP] Japan ..... 56-150021[U]

[51] Int. Cl.[3] ..... B21D 43/10
[52] U.S. Cl. ..... 72/422; 269/234; 414/740; 414/753
[58] Field of Search ..... 72/422; 269/233, 234; 414/740, 753

[56] References Cited

U.S. PATENT DOCUMENTS

| | | | |
|---|---|---|---|
| 1,972,329 | 9/1934 | Byerlein | 72/422 |
| 2,828,998 | 4/1958 | Seelye | 414/740 |
| 2,894,616 | 7/1959 | Young | 414/753 |
| 2,901,126 | 8/1959 | Halberstadt | 414/753 |
| 2,943,750 | 7/1960 | Sehn et al. | 414/740 |

FOREIGN PATENT DOCUMENTS

| | | | |
|---|---|---|---|
| 2231446 | 12/1974 | France | 72/422 |

*Primary Examiner*—Lowell A. Larson
*Attorney, Agent, or Firm*—Armstrong, Nikaido, Marmelstein & Kubovcik

[57] ABSTRACT

A mechanism for successively feeding sheetlike workpieces into a press in timed relation to the up-and-down motion of a slide carrying an upper die. Linked to an infeed cam mechanism which is driven from the same shaft as is the press slide, a carriage reciprocates horizontally between a retracted position away from the dies and a loading position close thereto. The carriage carries a pair of gripping jaw assemblies for gripping each workpiece in the retracted position of the carriage and releasing the workpiece in the loading position. Each gripping jaw assembly comprises upper and lower jaws jointly movable along a pair of guide rods extending at an angle to the plane of the horizon, the lower jaw being further cam-operated for pivotal motion toward and away from the upper jaw. The infeed cam mechanism driving the carriage is provided with a lockpin for retaining the carriage in the retracted position during replacement of the press dies.

7 Claims, 5 Drawing Figures

INFEED MECHANISM FOR A PRESS

BACKGROUND OF THE INVENTION

This invention relates to a mechanism for feeding sheetlike workpieces into a press one after another in timed relation to the up-and-down motion of an upper die or of a press slide for carrying the upper die.

A press infeed mechanism has been known which comprises a pair of gripping jaw assemblies mounted to a carriage movable toward and away from the press dies in step with the up-and-down motion of the upper die. The gripping jaw assemblies grip one workpiece in the retracted position of the carriage, carry the workpiece into the press with the carriage, and release and deposit the workpiece on the lower die. A problem has been encountered in returning the gripping jaw assemblies to the initial position. In order for the jaw assemblies not to interfere with the next workpiece to be fed into the press, the carriage with the jaw assemblies has heretofore been first moved upwardly from the loading position, then backwardly, and then down to the initial retracted position. Such back-and-forth and up-and-down movements of the carriage with the jaw assemblies necessitate, of course, very complex and bulky means, materially adding to the manufacturing cost of the press system including the infeed mechanism.

The known press infeed mechanism has had another problem arising in changing die assemblies, as the operation of the infeed mechanism is timed to the up-and-down motion of the press slide. The usual die-changing practice in presses of the type under consideration is to mount a new die assembly on a bolster plate and, after removal of the old die assembly with its bolster plate from the press, to introduce the new die assembly into the press for deposition on its bed via the bolster plate. Then the slide is lowered onto the upper die, and the latter is clamped onto the former. As the slide is subsequently raised with the upper die, the press is ready to resume operation with the new die assembly.

However, since the carriage travels forwardly with the descent of the slide, the pair of gripping jaw assemblies carried thereby would collide with the die assembly on the bolster plate unless measures were taken against such collision. One conventional measure has been to make the jaw assemblies retractable in the loading position of the carriage, thus unnecessarily making the infeed mechanism complex in construction. It has also been known to remove the jaw assemblies from the carriage, but this adds to the labor involved in die change.

SUMMARY OF THE INVENTION

In view of the above state of the art the present invention seeks to make unnecessary the up-and-down motion of the carriage, together with the pair of gripping jaws mounted thereto, in feeding sheetlike workpieces into a press. The invention also seeks to make possible the change of die assemblies without the need for retracting the jaw assemblies or removing them from the carriage.

Stated in brief, the invention provides an improved infeed mechanism for successively feeding sheetlike workpieces into a press in timed relation to the up-and-down motion of an upper die or of a press slide for carrying the upper die. Included is an infeed cam mechanism driven from the same means as the slide to cause a carriage to reciprocate horizontally between a retracted and a loading position in step with the up-and-down motion of the slide. The carriage supports a pair of gripping jaw assemblies which grip the successive workpieces in the retracted carriage position and release them in its loading position. Each gripping jaw assembly comprises an upper jaw movable back and forth along guide means mounted to the carriage and extending at an angle to the plane of the horizon, and a lower jaw medially pivoted to the upper jaw. Both upper and lower jaws have a gripping end and a base end, with the gripping ends of the jaws being adapted to grip the work therebetween. Acting between the base ends of the upper and lower jaws is a grip cam mechanism coupled to a linear actuator mounted to the carriage whereby the jaws are moved along the guide means by the linear actuator via the grip cam mechanism. The grip cam mechanism is operated by the linear actuator, both on its full extension and full contraction, to cause the pivotal motion of the gripping end of the lower jaw toward the gripping end of the upper jaw. Also included are lock means for preventing the infeed cam mechanism from reciprocating the carriage and retaining same in the retracted position during a change from one die assembly to another.

Particular attention is called to the grip cam mechanism of each gripping jaw assembly, causing the closure of the gripping jaws both upon full extension and full contraction of the linear actuator. The closure of the gripping jaws upon full extension of the linear actuator is necessary for gripping each workpiece. As the linear actuator is fully contracted in the retracted position of the carriage, the closed gripping jaws are sufficiently retracted upwardly to allow the next workpiece to be brought to a position where it is to be gripped by the jaws upon subsequent extension of the actuator. Thus the carriage need not move up and down but is only required to reciprocate horizontally.

Another pronounced feature of the invention resides in the lock means acting on the infeed cam mechanism to lock the carriage in the retracted position in spite of the operation of the drive means moving the press slide up and down. With the carriage thus held retracted, dies can be changed without retracting the jaw assemblies into the carriage or without removing the jaw assemblies from the carriage.

The above and other features and advantages of this invention and the manner of attaining them will become more apparent, and the invention itself will best be understood, from a study of the following description of a preferred embodiment, with reference had to the attached drawings.

DESCRIPTION OF THE PREFERRED EMBODIMENT

Figure 1:
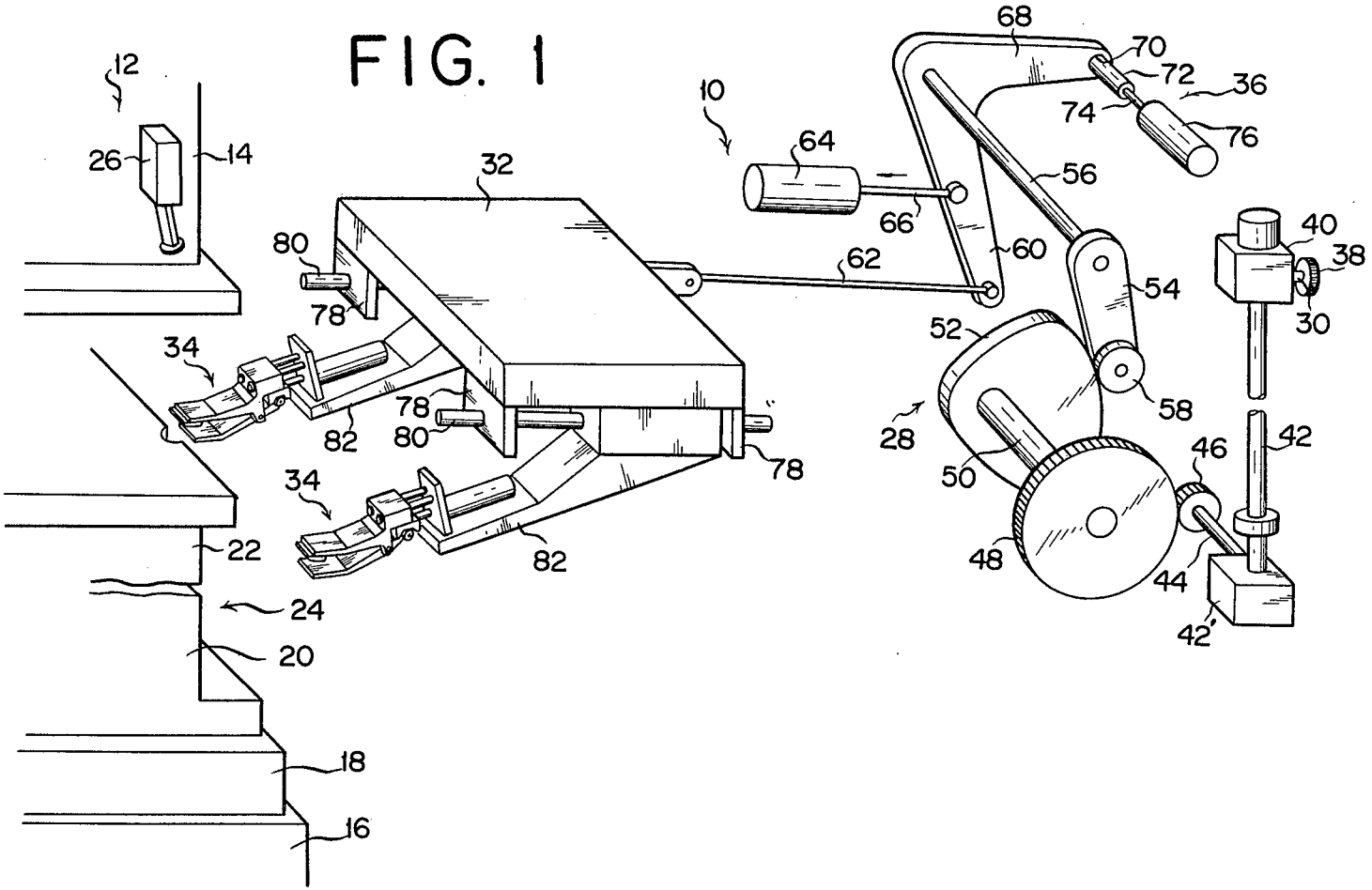
FIG. 1 is a schematic representation showing in perspective the general organization of the infeed mechanism for a press constructed in accordance with the principles of the invention.

The reference numeral 10 in FIG. 1 generally designates the infeed mechanism of this invention, shown together with a press proper generally referenced 12. The press itself can be of known construction comprising a slide 14 and a bed 16. Placed on the bed 16 is a bolster plate 18 having mounted thereon a lower die 20 and an upper die 22 constituting in combination a die assembly 24. This die assembly is shown just installed in the press, with the upper die 22 not yet attached to the slide 14. In operation, of course, the upper die 22 is secured to the slide 14 by clamps one of which is seen at 26.

The infeed mechanism 10 of this invention functions to feed successive sheetlike workpieces, not shown in FIG. 1, into the press proper 12 while the upper die 22 is raised away from the lower die 20. Broadly, the infeed mechanism comprises:

1. An infeed cam mechanism 28 coupled to a drive shaft 30 to be powered thereby.
2. A carriage 32 linked to the infeed cam mechanism 28 thereby to be reciprocated horizontally between a retracted position away from the die assembly 24 and a loading position close to the die assembly.
3. A pair of gripping jaw assemblies 34 mounted to the carriage 32 for gripping the successive workpieces in its retracted position and for releasing and placing them on the lower die 20 in the loading position of the carriage.
4. A lock mechanism 36 for locking the carriage 32 in its retracted position during die change in spite of the operation of the infeed cam mechanism 28.

The drive shaft 30 powering the infeed mechanism 10 is also coupled to the press slide 14 via a gear 38 and other conventional means, not shown, to cause the desired up-and-down motion of the slide with the upper die 22. The drive shaft 30 is coupled to the infeed cam mechanism 28 via a drive linkage comprising bevel gearing 40, shaft 42, bevel gearing 42', shaft 44, pinion 46, and gear 48. The gear 48, the final element of the drive linkage, is fixedly mounted on a camshaft 50 of the infeed cam mechanism 28.

Also fixedly mounted on the camshaft 50 is a disc cam 52 to be hereinafter referred to as the infeed cam in contradistinction to other cams that are to appear as the description proceeds. A lever 54 is nonrotatably mounted at one end on a rotatable shaft 56 oriented parallel to the camshaft 50. The other, free end of this lever has a cam follower roll 58 rotatably mounted thereon for rolling contact with the contoured edge of the infeed cam 52. Thus, upon rotation of the camshaft 50, the infeed cam 52 causes the oscillation of the lever 54 via the cam follower roll 58 and, in consequence, the bidirectional rotation of the shaft 56.

A second lever 60 is rigidly mounted at one end on the rotatable shaft 56 for simultaneous oscillation with the first recited lever 54. The free end of this second lever is pin jointed to one end of a link 62, the other end of which is also pin jointed to the carriage 32. An air cylinder 64, suitably supported, has its piston rod 66 coupled to the second lever 60 for biasing same in a clockwise direction, as viewed in FIG. 1, and hence for urging the cam follower roll 58 against the infeed cam 52.

The second lever 60 is formed integral with an arm 68 having a hole 70 formed in its distal end. Arranged for movement into and out of this hole is a lockpin 72 on the piston rod or output shaft 74 of a linear actuator 76 such as a fluid actuated cylinder. The lockpin 72 and the actuator 76, as well as the arm 68, constitute in combination the lock mechanism 36. It is to be noted that the lockpin 72 is movable into the hole 70 in the arm 68 only when the first 54 and second 60 levers are swung to the extreme position in a counterclockwise direction by the infeed cam 52, that is, when the carriage 32 is in the retracted position.

The carriage 32 has two pairs of depending lugs 78 which are bored to slidably fit over a pair of guide rods 80 extending horizontally in parallel spaced relation to each other. Also depending from the carriage 32 and angled leftwardly or forwardly are a pair of arms 82 carrying the pair of gripping jaw assemblies 34 respectively. The gripping jaw assemblies will be detailed later in connection with FIGS. 2 to 5.

It is clear from the foregoing that during normal pressing operation, with the lockpin 72 withdrawn out of the hole 70 in the arm 68, the carriage 32 reciprocates horizontally between the retracted and loading positions in timed relation with the up-and-down motion of the press slide 14 carrying the upper die 22. Although the drive linkage from the shaft 30 to the press slide 14 is not illustrated because of its conventional nature, it is understood that the infeed cam 52 makes one complete revolution, resulting in one complete reciprocation of the carriage 32, with each up-and-down motion of the press slide. The pair of gripping jaw assemblies 34 engage the successive workpieces in the retracted position of the carriage, travel forwardly with the carriage, and release and deposit the workpieces on the lower die 20. The conventional up-and-down motion of the carriage is unnecessary by virtue of the improved construction of the gripping jaw assemblies to be discussed presently.

For a change from one die assembly to another the linear actuator 76 may be extended to insert the lockpin 72 into the hole 70 in the arm 68 when the first 54 and second 60 levers are pivoted to the extreme counterclockwise position by the infeed cam 52 as in FIG. 1. In this lever position the carriage 32 is retracted whereas the press slide 14 is in the uppermost position. Then the press slide may be lowered, and the upper die 22 may be unclamped in its lowermost position. Then the press slide may be lifted, with the upper die left resting on the lower die, and stopped and held standing by in its uppermost position.

Now the die assembly 24 may be withdrawn from the press 12 together with the bolster plate 18. Then another bolster plate having another die assembly mounted thereon may be introduced into the press and placed in position on the bed 16. Then the press slide 14 may be lowered to clamp the upper die of the new die assembly thereto in its lowermost position. The change of the die assemblies is completed as the press slide is subsequently raised and stopped in the uppermost position together with the upper die.

During the above die change the press slide 14 makes two vertical reciprocations, so that the infeed cam 52 completes two revolutions. However, since the levers 54 and 60 have been locked against oscillation by the lock mechanism 36, the carriage 32 stays in the retracted position. Thus the pair of gripping jaw assemblies 34 do not interfere with the die assemblies (particularly with the upper dies) being changed.

The following is the detailed description of the pair of gripping jaw assemblies 34, only one of which is illustrated on an enlarged scale and at different stages of operation in FIGS. 2 to 5. The two gripping jaw assemblies are of the same construction and operation, so that only one of them will be described in detail, both as to its construction and operation, it being understood that the same description applies to the other.

Figure 2:
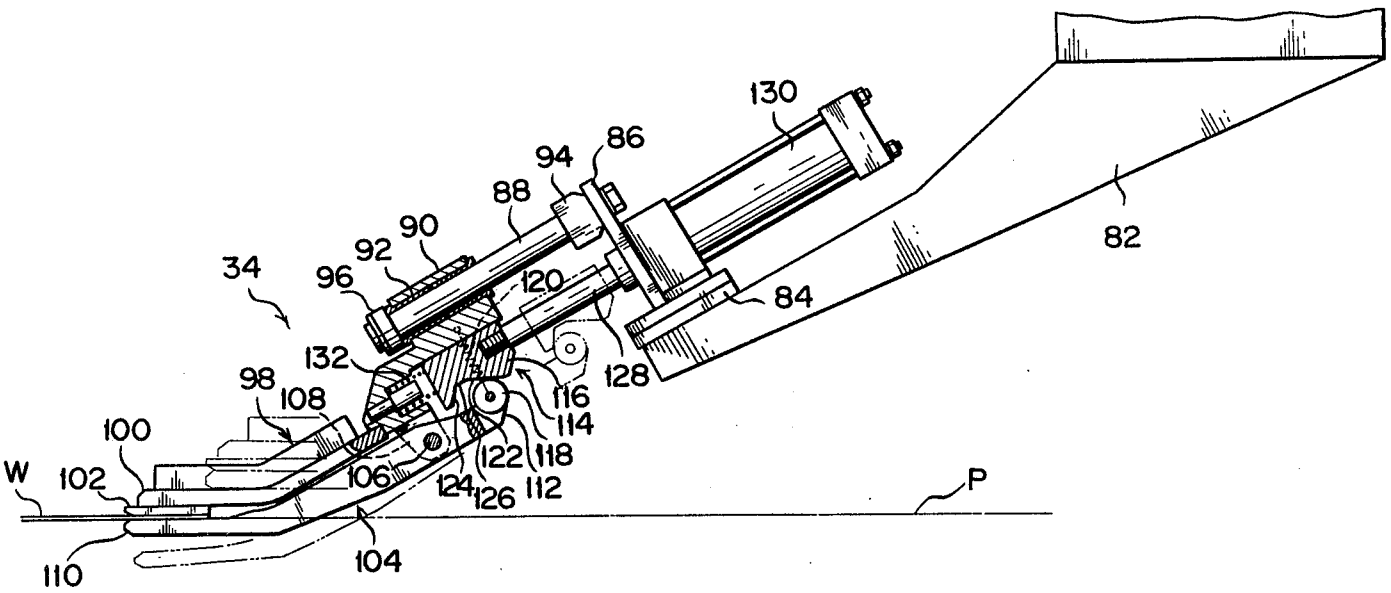
FIG. 2 is an enlarged elevation, partly shown in section for clarity, of one of the pair of gripping jaw assemblies in the infeed mechanism of FIG. 1, the jaw assembly being herein shown gripping a workpiece.

With particular reference to FIG. 2, wherein the representative jaw assembly is shown partly sectioned for clarity, the arm 82 anchored to the carriage 32 of FIG. 1 has mounting plates 84 on its distal end. A bracket 86 is affixed right-angularly to the mounting plates 84. Rigidly supported in a cantilever fashion by this bracket are a pair of guide rods 88, one seen, extending downwardly and forwardly therefrom in parallel spaced relation to each other, at an angle to the plane of the horizon.

A slide 90 is reciprocably mounted on the pair of guide rods 88 via bushings 92. The stroke of reciprocation of the slide 90 is determined by limit stops 94 and 96 at the opposite extremities of the guide rods 88. The slide 90 firmly carries an upper jaw 98 extending forwardly and downwardly therefrom. Although shown as separate entities, the slide 90 and the upper jaw 98 can be considered a single unit for the purposes of the invention, with the slide essentially forming the base end of the upper jaw. Extending away from the slide, the upper jaw terminates in a gripping end 100, complete with a tongue 102 fixed thereto, oriented horizontally.

Underlying the upper jaw 98 is a lower jaw 104 medially pivoted at 106 to a pair of lugs 108 depending from the slide 90, so that the lower jaw is pivotable relative to the upper jaw. The lower jaw 104 also has a gripping end 110 and a base end 112. The gripping end 110 of the lower jaw coacts with the gripping end 100 of the upper jaw to engage the sheetlike workpiece W therebetween.

The reference numeral 114 generally designates a grip cam mechanism acting between the base ends of the upper 98 and lower 104 jaws to cause the gripping end 110 of the lower jaw to move toward and away from the gripping end 100 of the upper jaw. The grip cam mechanism 114 comprises a grip cam 116 mounted under the slide 90 for relative sliding motion in a direction parallel to the guide rods 88, and a cam follower roll or rolls 118 rotatably mounted on the base end 112 of the lower jaw. A helical tension spring 120 extends between slide 90 and lower jaw base end 112 to urge the cam follower rolls 118 against the contoured lower surface of the grip cam 116. The lower surface of the grip cam is recessed to provide first 122 and second 124 opposed slopes and a root 126 therebetween.

The grip cam 116 is secured to the piston rod or output shaft 128 of a linear actuator 130 such as a fluid actuated cylinder mounted on the carriage arm 82 via the bracket 86. The actuator 130 is intended to perform the dual function of moving the jaws 98 and 104 back and forth along the guide rods 88 via the grip cam 116 and of moving the grip cam back and forth relative to the slide 90 for causing the pivotal motion of the lower jaw relative to the upper. For the performance of this dual function the actuator 130 must have a stroke longer than the stroke of the slide 90, the latter stroke being determined by the limit stops 94 and 96 on the guide rods 88. A helical compression spring is installed at 132 between slide 90 and grip cam 116 for biasing them away from each other in a direction parallel to the guide rods 88.

In the operation of each gripping jaw assembly 34 it will be seen that FIG. 2 shows the actuator 130 fully extended, with the slide 90 in abutting contact with the limit stops 96 on the guide rods 88 and with the compression spring 132 fully compressed. Since then the cam follower rolls 118 ride on the first slope 122 of the grip cam 116, the gripping end 110 of the lower jaw 104 is pivoted upwardly. Thus is the workpiece W engaged between the gripping ends 100 and 110 of the jaws.

It is to be noted that upon full extension of the actuator 130 as depicted in FIG. 2, the opposed surfaces of the gripping ends 100 and 110 of the jaws lie approximately on a predetermined horizontal plane P along which the successive workpieces are to be fed into the press 12 of FIG. 1. With the workpiece W thus gripped by the pair of gripping jaw assemblies 34, the carriage 32 travels forwardly from the retracted to the loading position, as has been explained in conjunction with FIG. 1.

Figure 3:
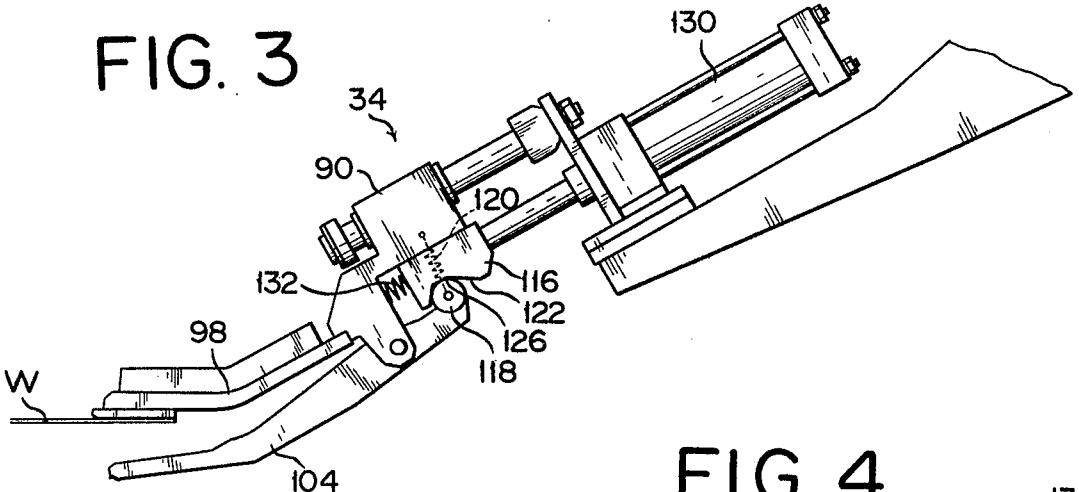
FIGS. 3, 4 and 5 are views similar to FIG. 2 but showing the gripping jaw assembly at different stages of operation.

For releasing the workpiece in the loading position the actuator 130 of each gripping jaw assembly 34 may be contracted, thereby first causing the grip cam 116 to move back relative to the slide 90 with the extension of the compression spring 132 which has been in a state of full compression. Thereupon the cam follower rolls 118 will fall from the first slope 122 of the grip cam 116 onto its root 126 under the bias of the tension spring 120, with the result that the lower jaw 104 is pivoted in a counterclockwise direction as shown in FIG. 3. Now the workpiece W is released.

Figure 4:
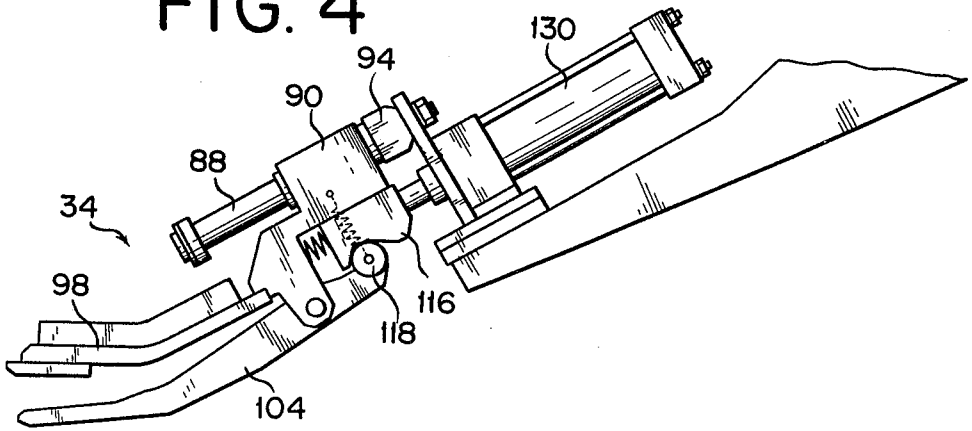

With the continued contraction of the actuator 130 the jaws 98 and 104 will travel upwardly and rearwardly along the guide rods 88 as the cam follower rolls 118 are in contact with both the second slope 124 and root 126 of the grip cam. The gripping jaws remain open during such continued contraction of the actuator 130. FIG. 4 shows the slide 90 thus moved into abutment against the limit stops 94 on the guide rods 88. The actuator 130 is not yet fully contracted, however.

Upon full contraction of the actuator 130 after the movement of the slide 90 into abutting engagement with the limit stops 94, the cam follower rolls 118 on the base end of the lower jaw 104 will relatively ride onto the second slope 124 of the grip cam 116. The result is the closure of the gripping jaws 98 and 104 as in FIG. 5. With the gripping jaws thus reclosed upon full contraction of the actuator 130, the gripping end of the lower jaw 104 is positioned a preassigned distance D above the noted horizontal plane P. Consequently the carriage 32 of FIG. 1 can be returned directly from the loading to the retracted position without causing interference of the gripping jaw assemblies 34 with the next workpiece to be fed into the press.

Figure 5:
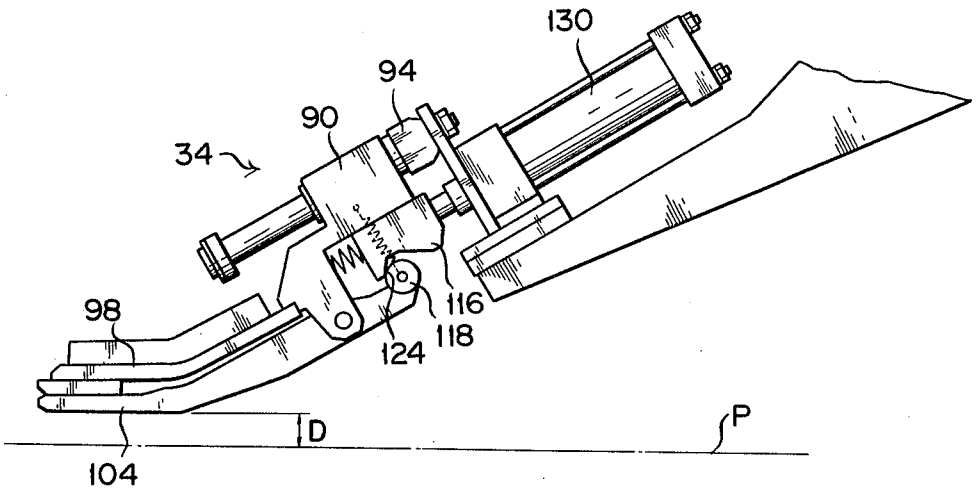

For gripping the next workpiece in the retracted position of the carriage the actuator 130 of each gripping jaw assembly 34 may be extended from its fully contracted state of FIG. 5. The gripping jaws 98 and 104 will then travel forwardly and downwardly in an open state as in FIGS. 3 and 4. Then, after the slide 90 comes into abutment against the limit stops 96, the extension of the actuator 130 continues thereby causing the sliding motion of the grip cam 116 relative to the slide 90 against the bias of the compression spring 132. Thereupon the cam follower rolls 118 will ride onto the first slope 122 of the grip cam 116, with the consequent engagement of the next workpiece by the gripping jaws 98 and 104 as in FIG. 2.

Thereafter the above cycle of operation is repeated to feed successive workpieces into the press. The extension and contraction of the linear actuators 130 of the gripping jaw assemblies 34 are of course timed to the back-and-forth travel of the carriage 32 and to the up-and-down motion of the press slide 14.

It is understood that various changes may be made in the form, details, arrangements, and proportions of the parts in the above embodiment, which has been chosen only to pictorially represent the principles of the invention, without departing from the scope of the invention as set forth in the following claims.

What is claimed is:

1. In a press wherein an upper die or press slide is moved up and down relative to a lower die by drive means, an infeed mechanism for successively feeding sheetlike workpieces into the press in timed relation to the up-and-down motion of the upper die or press slide, comprising:

(a) an infeed cam mechanism driven from the same drive means as the upper die or press slide;

(b) a carriage linked to the infeed cam mechanism thereby to be reciprocated horizontally between a retracted position away from the dies and a loading position close to the dies;

(c) a pair of gripping jaw assemblies carried by the carriage for gripping each of the successive sheetlike workpieces in the retracted position of the carriage and for releasing the workpiece in the loading position thereof, each gripping jaw assembly comprising:

(1) guide means on the carriage extending at an angle to the plane of the horizon;

(2) an upper jaw having a gripping end and a base end and movable back and forth along the guide means;

(3) a lower jaw also having a gripping end and a base end and medially pivoted to the upper jaw, the gripping ends of the upper and lower jaws being adapted to engage the successive workpieces therebetween;

(4) a grip cam mechanism acting between the base ends of the upper and lower jaws; and (5) a linear actuator mounted to the carriage and coupled to the grip cam mechanism for moving therethrough the upper and lower jaws back and forth along the guide means, the grip cam mechanism being adapted to cause the pivotal motion of the gripping end of the lower jaw toward the gripping end of the upper jaw upon both full extension and full contraction of the linear actuator; and (d) a lock mechanism for preventing the infeed cam mechanism from reciprocating the carriage and retaining the latter in the retracted position during die replacement.

2. The invention of claim 1, wherein the infeed cam mechanism comprises:

(a) a camshaft coupled to the drive means thereby to be rotated;

(b) an infeed cam mounted on the camshaft for joint rotation therewith;

(c) a rotatable shaft parallel to the camshaft;

(d) a first lever fixedly mounted on the rotatable shaft and adapted to be oscillated by the infeed cam;

(e) a second level fixedly mounted on the rotatable shaft for simultaneous oscillation with the first lever and operatively linked to the carriage to cause the reciprocation thereof; and (f) means for yieldably urging the first lever against the infeed cam.

3. The invention of claim 2, wherein the lock mechanism comprises:

(a) a lockpin movable into and out of a hole formed in the second lever; and (b) a linear actuator for moving the lockpin into and out of the hole in the second lever.

4. The invention of claim 1, wherein the grip cam mechanism of each gripping jaw assembly comprises:

(a) a grip cam disposed under the base end of the upper jaw for relative sliding motion in a direction parallel to the guide means, the grip cam being coupled to the linear actuator;

(b) cam follower means on the base end of the lower jaw; and (c) resilient means acting between the upper and lower jaws for urging the cam follower means against the grip cam.

5. The invention of claim 4, wherein the stroke of travel of the grip cam of each gripping jaw assembly by the linear actuator is longer than the stroke of the upper and lower jaws along the guide means, and wherein each gripping jaw assembly further comprises second resilient means acting between the upper jaw and the grip cam for urging same away from each other in a direction parallel to the guide means.

6. The invention of claim 5, wherein the grip cam of each gripping jaw assembly is recessed to provide two opposed slopes and a root therebetween, with the cam follower means on the base end of the lower jaw riding on the slopes of the grip cam upon full extension and full contraction of the linear actuator to cause the pivotal motion of the gripping end of the lower jaw toward the gripping end of the upper jaw.

7. The invention of claim 6, wherein upon full extension of the linear actuator, the gripping ends of the upper and lower jaws engage therebetween the successive sheetlike workpieces on a predetermined horizontal plane along which the workpieces are to be fed into the press, and upon full contraction of the linear actuator, the gripping end of the lower jaw is positioned a preassigned distance above the predetermined horizontal plane.

* * * * *